US005760317A

United States Patent [19]

Kapoor

[11] Patent Number: 5,760,317

[45] Date of Patent: Jun. 2, 1998

[54] FLOW SOFTENING TUNGSTEN BASED COMPOSITES

[75] Inventor: Deepak Kapoor, Rockaway, N.J.

[73] Assignee: The United States of America as represented by the Secretary of the Army, Washington, D.C.

[21] Appl. No.: 540,618

[22] Filed: Oct. 27, 1995

[51] Int. Cl.[6] ..... C22C 27/04

[52] U.S. Cl. ..... 75/248; 420/430; 102/517

[58] Field of Search ..... 75/248; 419/48, 419/49, 11; 420/430, 431; 102/517

[56] References Cited

U.S. PATENT DOCUMENTS

| | | | |
|---|---|---|---|
| H1075 | 7/1992 | Kapoor | 420/430 |
| 3,116,145 | 12/1963 | Semchyshen . | |
| 3,150,971 | 9/1964 | Weisert et al. . | |
| 3,222,166 | 12/1965 | Thompson et al. . | |
| 3,946,673 | 3/1976 | Hayes | 102/52 |
| 4,851,042 | 7/1989 | Bose et al. | 75/248 |
| 4,908,182 | 3/1990 | Whang | 420/430 |
| 4,960,563 | 10/1990 | Nicolas | 419/23 |

*Primary Examiner*—Ngoclan Mai

*Attorney, Agent, or Firm*—Edward Stolarun; Edward Goldberg; John E. Callaghan

[57] ABSTRACT

Disclosed is a flow-softening tungsten alloy having the general formula:

$$W_{100-p}T_xM_yB_z$$

wherein W is tungsten; T is one or more elements selected from the group consisting of titanium, zirconium and hafnium; M is one or more elements selected from the group consisting of molybdenum, tantalum, iron, cobalt, nickel, manganese and vanadium; B is one or more of the elements selected from the group consisting of boron, carbon, silicon and aluminum; x is from 5 to 30 weight percent; y is from 1 to 10 weight percent; z is from 0 to 2 weight percent; and p is equal to or less than 30 weight percent. In this alloy p is approximately equal to the sum of x, y and z. A method of preparing this alloy and a kinetic energy penetrator manufactured from it are also disclosed.

2 Claims, 8 Drawing Sheets

FLOW SOFTENING TUNGSTEN BASED COMPOSITES

BACKGROUND OF THE INVENTION

1. Field of the Invention

The present invention relates to tungsten alloys and, in particular, to sintered tungsten heavy alloys.

2. Brief Description of the Prior Art

Conventional liquid phase sintered tungsten heavy alloys (WHA) have attractive property combinations of high density, high strength and high ductility. As a result, this class of alloys is very useful for numerous applications like radiation shields, counter balances, electrical contacts and heat sinks in microelectronic systems. The high density of these materials make them particularly useful for kinetic energy penetrator application. However, the penetration performance of tungsten heavy alloy kinetic energy (long rod) projectiles is inferior to that of equivalent projectiles manufactured from depleted uranium alloys. Despite the superior performance of depleted uranium munitions, there are many environmental and/or political concerns associated with their manufacturing and their use in the battlefield. These concerns have prompted continuing efforts within the Army to develop a less hazardous, and environmentally more benign, tungsten-based penetrator material which is capable of equalling or surpassing the performance of depleted uranium alloys.

Prior research efforts seeking improvements in the penetration capabilities of tungsten heavy alloys penetrator materials have focused on increases in strength, ductility and toughness of the WHA's and have not been successful. Recent studies at United States Army Laboratories, however, have established that it is the rate at which deformation takes place in the penetration process, not the materials initial strength or ductility, which governs its performance. The rapid flow-softening behavior of uranium alloys, a function of both their mechanical and thermal properties, was shown to be responsible for their superior ballistic performances.

SUMMARY OF THE INVENTION

An objective of the present invention is to develop novel isotropic, plastically unstable alloys. Another objective of the disclosure is to provide proof that flow softening in tungsten based composites can be achieved by replacing nickel base matrix with thermomechanically unstable alloy.

This invention relies primarily on modifications and replacements of the nickel-based matrix in the conventional WHA's with thermomechanically less stable elements or alloys. Critical issues include the roles and interactions between matrix and tungsten phase in the thermomechanical properties of the overall composite and the nucleation and growth of plastic localizations in these novel alloys. The invention is broadly directed to tungsten-based composites having the general formula:

$$W_{100-P}T_xM_yB_z$$

wherein W is tungsten, T is one or more elements selected from the group consisting of titanium, zirconium and hafnium; M is one or more elements selected from the group consisting of molybdenum, tantalum, iron, cobalt, nickel, manganese and vanadium; B is one or more elements selected from the group consisting of boron, carbon, silicon and aluminum; x is from 5–30 weight percent, y is from 1–10 weight percent and z is from 0–2 weight percent; and P equals x+y+z and P≦30 weight percent. The skilled artisan will readily appreciate that the alloys according to the invention may be binary, ternary or quaternary. The composition of matrix element or alloy is adjusted to form a thermomechanically less stable phase than nickel based matrix in conventional WHA'S.

In another aspect, the invention is directed to the method for preparing novel flow-softening tungsten rich alloys. One of the pre-requisites of the process selected is to prevent any intermetallic phase formation during the processing of these tungsten based composites. The process comprises the steps of blending a mixture of the powdered, elemental components or alloys, and hot consolidating the blended powders to near full density. In the first step, a mixture of high purity elemental powders corresponding to the components of a desired alloy, are blended using typical powder blenders well known in the art. Preferably, powder size and distribution is controlled to have a uniform distribution of tungsten particles in a continuous, homogenous matrix. In still another aspect, the invention is directed to a kinetic energy penetrator comprising a novel flow-softening tungsten alloy.

BRIEF DESCRIPTION OF THE DRAWINGS

FIG. 1(*b*) is a photograph similar to FIG. 1(*a*) showing a W-20Zr alloy;

FIG. 1(*c*) is a photograph similar to FIG. 1(*a*) showing a W-20Ti alloy;

FIG. 1(*d*) is a photograph similar to FIG. 1(*a*) showing a W-7.5Ti–7.5Hf alloy;

FIG. 2(*b*) is an optical microscope photograph showing a Tungsten-Tm unstable matrix residual penetrator;

FIG. 3(*b*) is a longitudinal cross-sectional optical microscope photograph of a W-28Hf alloy at the same scale as FIG. 3(*a*).

DETAILED DESCRIPTION OF THE PREFERRED EMBODIMENT

The thoroughly blended powder mixture is then hot consolidated at temperatures high enough to achieve full densification but lower than a critical temperature to prevent intermetallic phase formation between the tungsten and the matrix phase. Hot consolidation techniques are well known in the art and include, for example, hot isostatic pressing (HIPping), high temperature extrusion and vacuum hot pressing. Preparation of large quantities of the tungsten based composites according to the invention is preferably carried out using hot isostatic pressing and/or hot extrusion.

The hot consolidated tungsten based composites are further analyzed for density and microstructure. Presence of intermetallic phases is detected by X-ray diffraction and electron microscopy techniques. Fully dense material is machined to sub-scale test specimens and subjected to reverse ballistic testing to screen compositions which undergo flow-softening under high strain rate ballistic impact conditions.

To more fully illustrate this invention, the following examples are presented.

EXAMPLES

Elemental powders of tungsten and hafnium are blended to produce a blend consisting essentially of 72% by weight tungsten and 28% by weight of hafnium. The average particle size of tungsten powder is 70 μm and the average particle size of hafnium powder is 25 μm. The resulting blend is hot pressed at 1100° C., 1200° C., 1300° C., 1400° C. and 1500° C. into 0.5 inch diameter cylindrical slugs. All of the samples had a density which is less than the theoretical density of about 17g/cc for this blend. X-ray diffraction and optical microscopy revealed that hot pressing above 1300° C. resulted in the formation of intermetallic $HfW_2$. Therefore, further processing of the tungsten base composites under the present invention was limited to a maximum of 1300° C.

Table I lists a series of alloys which were blended and hot isostatically pressed. The HIPped densities of the blends ranged between 97.5% to 99.6% of their theoretical densities. Samples were prepared from each hot consolidated bar for optical microscopy to reveal the microstructure. Almost all the blends showed a uniform distribution of tungsten particles in a continuous matrix phase. FIG. 1 illustrates the microstructure of some of these compositions. Sub-scale test specimens were machined out of each bar and subjected to reverse ballistic screening test to reveal flow-softening.

Figure 1A:
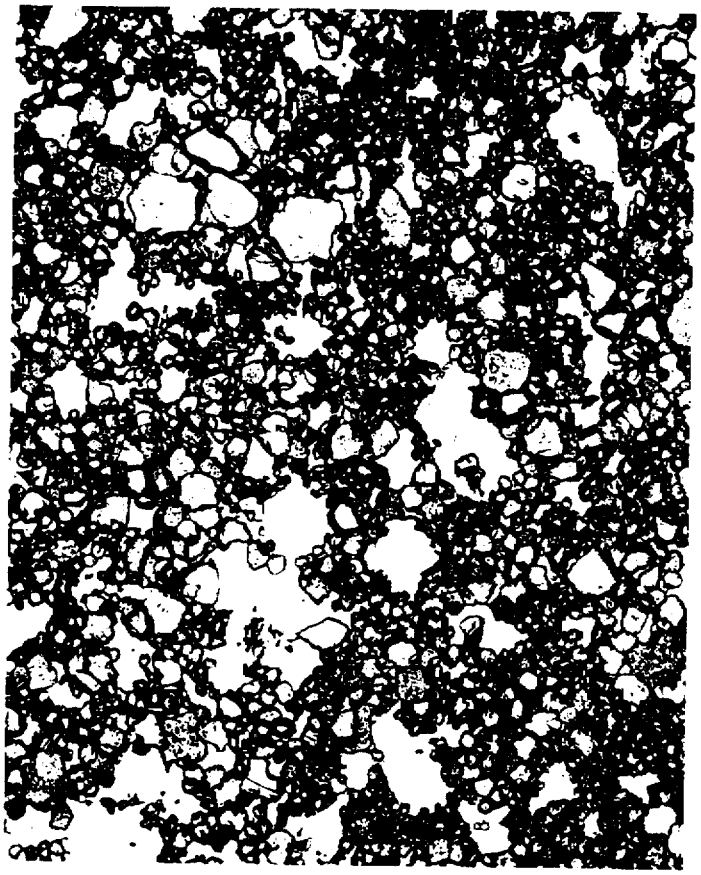
FIG. 1(*a*) is an optical microscope photograph showing a W-20Hf alloy at a scale of 1 cm being equal to 50 μm.
Figure 1B:
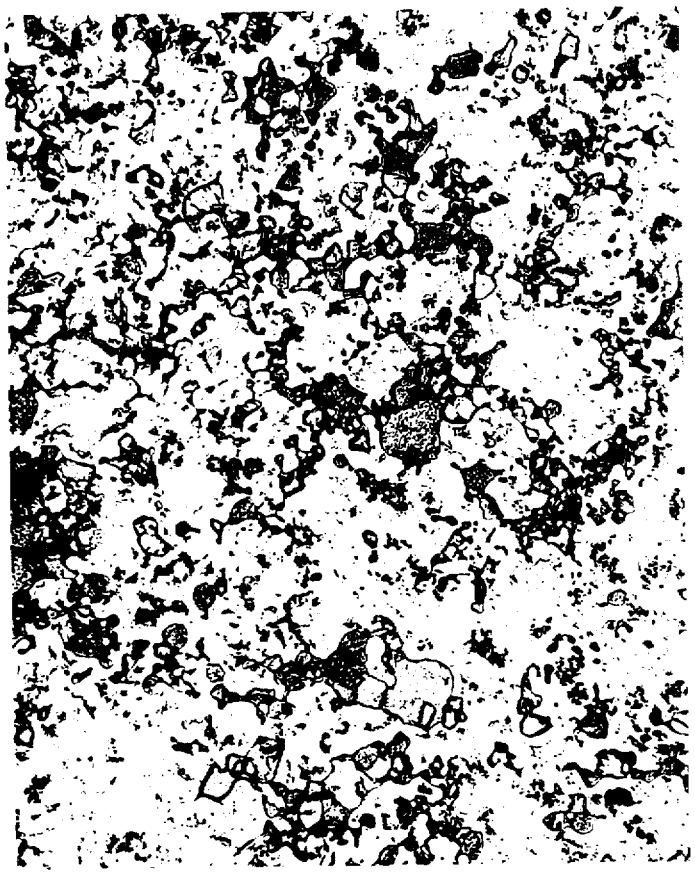
Figure 1C:
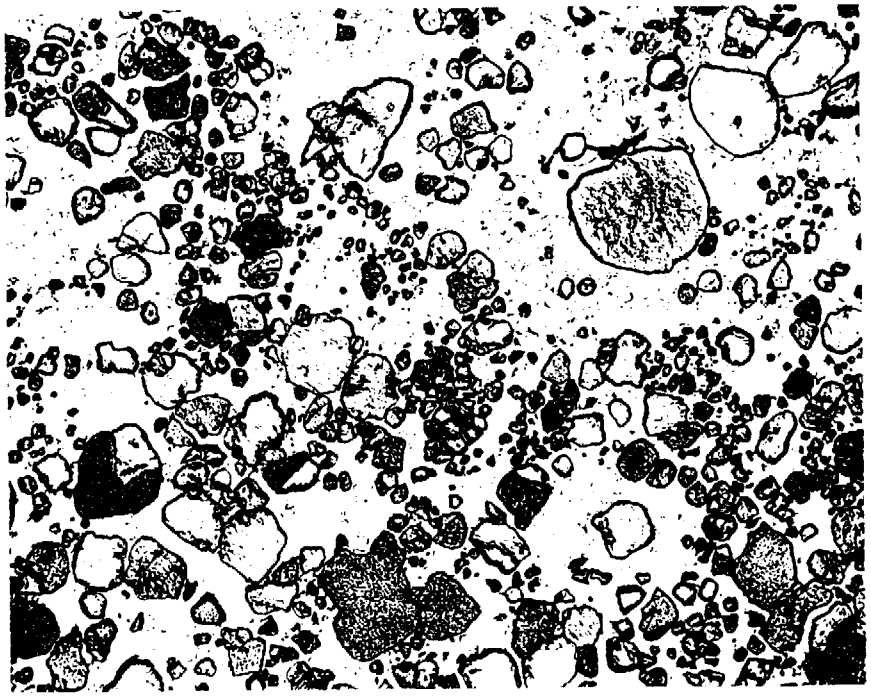
Figure 1D:
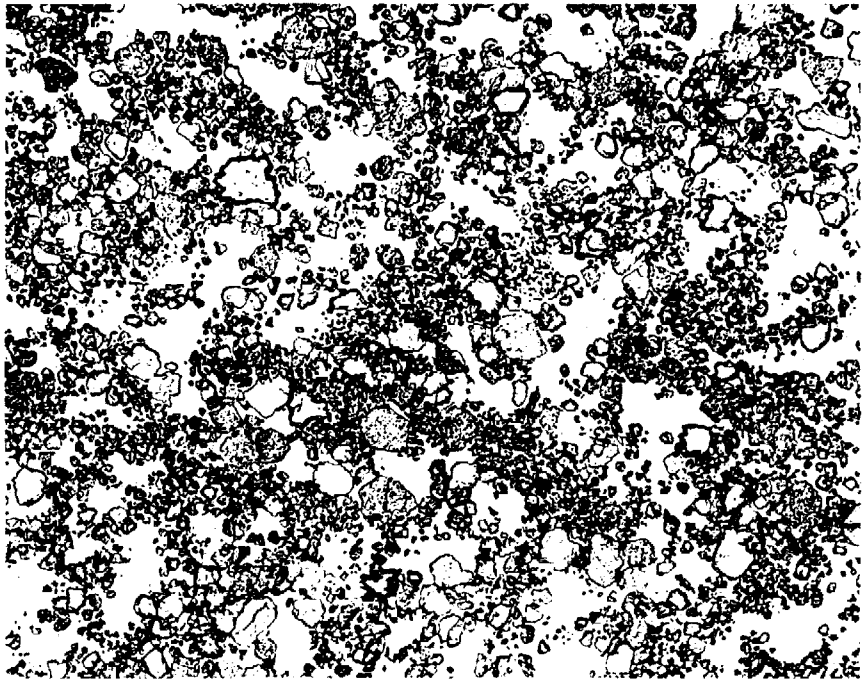
Figure 2A:
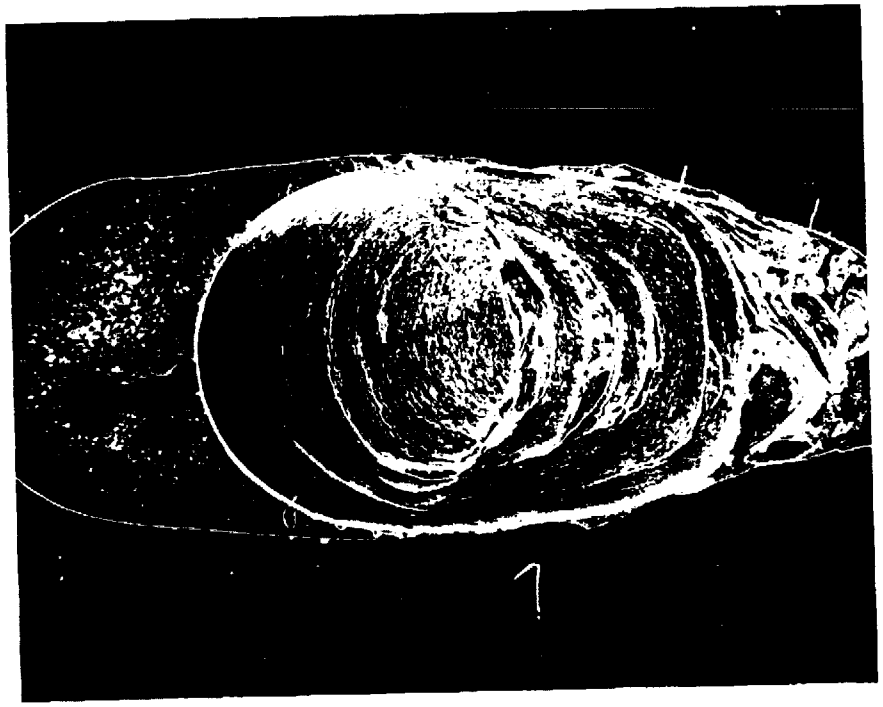
FIG. 2(*a*) is an optical microscope photograph showing a tungsten-Tm stable matrix residual penetrator.
Figure 2B:
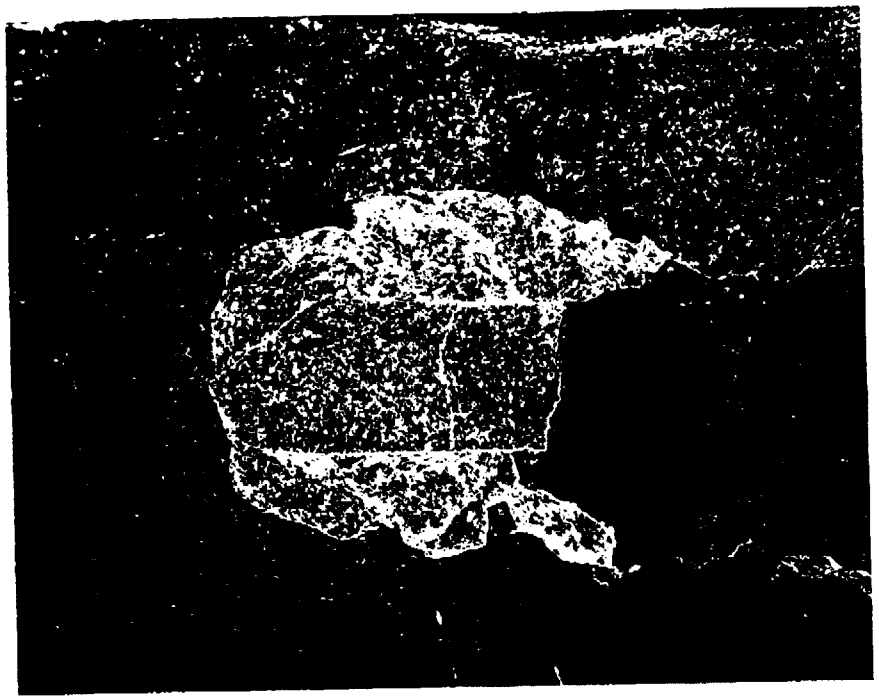

Table I also includes compositions such as tungsten-copper, tungsten-niobium and tungsten-nickel-iron, which are outside the scope of this invention and therefore do not reveal flow-softening because the matrix component of these tungsten base composites is thermomechanically stable. These compositions have been included for comparison purpose only. FIG. 2 shows the macrostructure of the tungsten based composites after reverse ballistic testing. The material with thermomechanically stable matrix undergoes a large plastic deformation where as the material with thermomechanically unstable matrix which revealed flow-softening undergoes plastic localization. The relevance of flow-softening lies in the fact that all those compositions which reveal this phenomenon, also show much higher ballistic penetration capability than those compositions which do not undergo flow-softening. Additionally, the data shows that there is a minimum percentage of matrix required to flow-soften the whole tungsten base composite.

Figure 3A:
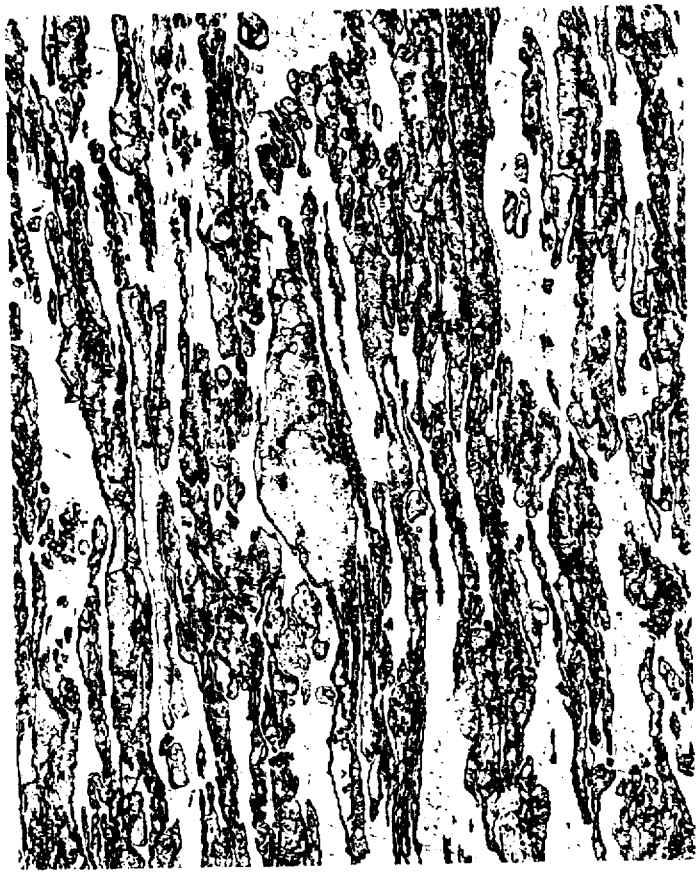
FIG. 3(*a*) is a cross-sectional optical microscope photograph of a W-28Hf alloy at a scale of 1 cm equal to 50 μm.
Figure 3B:
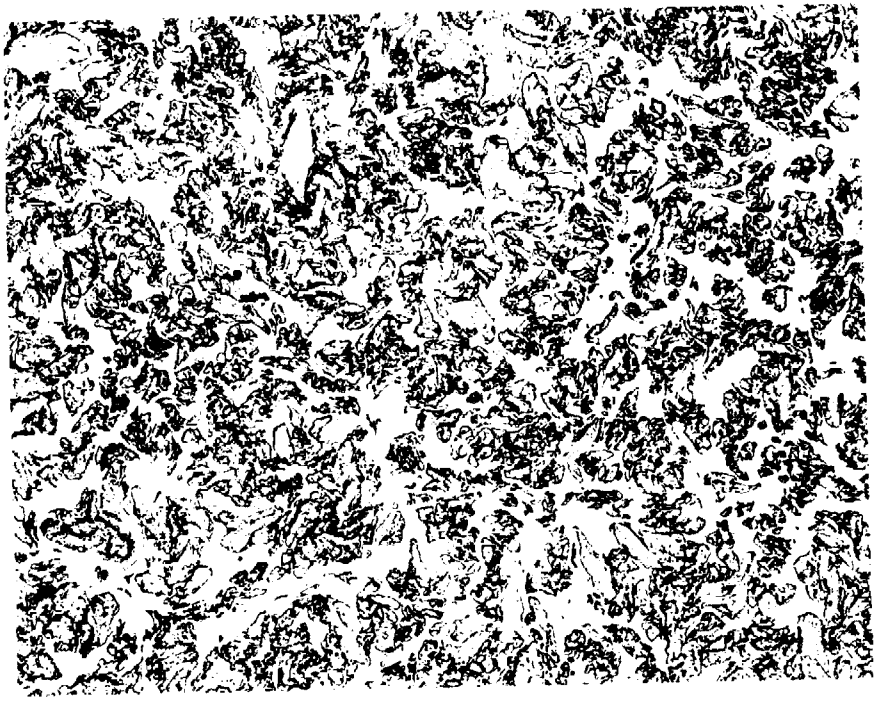

In another set of experiments, elemental powders of tungsten and hafnium are blended to produce a blend consisting essentially of 72% by weight tungsten and 28% by weight of hafnium. The average particle size of tungsten powder is 70 μm. The blended powders are hot consolidated by extrusion at preheat temperatures over the temperature range of 1100° C. to 1400° C. Materials were fully dense and exhibited substantial elongation of tungsten phase within the hafnium matrix, which was further elongated by re-extrusion. FIG. 3, shows the microstructure of the hot extruded material. The flow stress, as characterized by the extrusion constant, decreases with increasing temperature up to 1300° C. and increases substantially at 1400° C. as significant quantities of intermetallic phase is formed.

The extruded tungsten base composites also revealed flow-softening similar to their HIPped counterpart; which leads to improvement in their ballistic penetration performance over the base line tungsten-nickel-iron alloys.

In accordance with the invention, novel tungsten based composites showed flow-softening behavior and improved penetration performance when the nickel based matrix in the conventional WHA's is replaced with a thermomechanically less stable element or alloy.

While preferred embodiments of the invention have been described, it is to be understood that the scope of the invention is defined by the following claims.

TABLE I

| Alloy Composition Wt. % | Process Conditions | REVERSE BALLISTIC SCREENING Flow-Softening? |
|---|---|---|
| $W_{75}Cu_{25}$ | 1000° C./4H, 30,000 PSI | No |
| $W_{50}Cu_{50}$ | 1000° C./4H, 30,000 PSI | No |
| $W_{90}Ni_7Fe_3$ | 1000° C./4H, 30,000 PSI | No |
| $W_{90}Ni_7Fe_3$ | Liquid Phase Sintered | No |
| $W_{90}Cu_{10}$ | Liquid Phase Sintered | No |
| $W_{90}Hf_{10}$ | 1300° C./4H, 30,000 PSI | Yes |
| $W_{80}Hf_{20}$ | 1300° C./4H, 30,000 PSI | Yes |
| $W_{72}Hf_{28}$ | 1300° C./4H, 30,000 PSI | Yes |
| $W_{90}Zr_{10}$ | 1300° C./4H, 30,000 PSI | Yes |
| $W_{80}Zr_{20}$ | 1300° C./4H, 30,000 PSI | Yes |
| $W_{90}Ti_{10}$ | 1300° C./4H, 30,000 PSI | Yes |
| $W_{80}Ti_{20}$ | 1300° C./4H, 30,000 PSI | Yes |
| $W_{80}Nb_{20}$ | 1300° C./4H, 30,000 PSI | No |
| $W_{90}Ti_5Hf_5$ | 1300° C./4H, 30,000 PSI | Marginal |
| $W_{95}Ti_{2.5}Hf_{2.5}$ | 1300° C./4H, 30,000 PSI | No |
| $W_{85.0}Ti_{7.5}Hf_{7.5}$ | 1300° C./4H, 30,000 PSI | Yes |
| $W_{80}Ti_{10}Hf_{10}$ | 1300° C./4H, 30,000 PSI | Yes |
| $W_{90}Ti_{8.5}Mn_{1.5}$ | 1300° C./4H, 30,000 PSI | Yes |
| $W_{80}Ti_{17}Mn_3$ | 1300° C./4H, 30,000 PSI | Yes |
| $W_{90}Ti_8Mo2_3$ | 1300° C./4H, 30,000 PS | Yes |
| $W_{80}Ti_{16}Mo_4$ | 1300° C./4H, 30,000 PSI | Yes |
| $W_{90}Ti_7Mo_2Hf_1$ | 1300° C./4H, 30,000 PSI | Yes |
| $W_{80}Ti_{14}Mo_4Hf_2$ | 1300° C./4H, 30,000 PSI | Yes |
| $W_{95}Ti_{4.5}Al_{0.3}V_{0.2}$ | 1300° C./4H, 30,000 PSI | No |
| $W_{90}Ti_9Al_{0.6}V_{0.4}$ | 1300° C./4H, 30,000 PSI | Marginal |
| $W_{85}Ti_{13.5}Al_{0.9}V_{0.6}$ | 1300° C./4H, 30,000 PSI | Yes |
| $W_{80}Ti_{18}Al_{1.2}V_{0.8}$ | 1300° C./4H, 30,000 PSI | Yes |

What is claimed is:

1. A tungsten heavy alloy kinetic energy penetrator having improved ballistic penetration, said alloy having a composition that exhibits rapid flow softening and plastic localization and which has a thermomechanically unstable alloy phase and a microstructure free of intermetallic phases with tungsten and where the formulae for the proportion of tungsten, the alloy elements and the proportions of alloy elements are selected from members of the group consisting of:

(a) 80%W, 18%Ti, 1.2%Al, 0.8%V, (b) 85%W, 13.5%Ti, 0.9%Al, 0.6%V, (c) 80%W, 14%Ti, 4%Mo, 2%Hf, (d) 90%W, 7%Ti, 2%Mo, 1%Hf, (e) 80%W, 16%Ti, 4%Mo, (f) 90%W, 8%Ti, 2%Mo, (g) 80%W, 17%Ti, 3%Mn, (h) 90%W, 8.5%Ti, 1.5%Mn, (i) 80%W, 10%Ti, 10%Hf, and (j) 85%W, 7.5%Ti, 7.5%Hf.

2. The penetrator of claim 1 having a density in the range of 97.5 to 99.6% of the theoretical maximum density of the composition.

* * * * *